United States Patent [19]

Schulz

[11] Patent Number: 4,869,731

[45] Date of Patent: Sep. 26, 1989

[54] PROCESS FOR THE THERMAL DECOMPOSITION OF TOXIC REFRACTORY ORGANIC SUBSTANCES

[75] Inventor: Helmut Schulz, Harrison, N.Y.

[73] Assignee: Dynecology, Incorporated, Harrison, N.Y.

[21] Appl. No.: 106,144

[22] Filed: Oct. 7, 1987

[51] Int. Cl.[4] ..... C10J 3/46

[52] U.S. Cl. ..... 48/197 R; 48/206; 48/209; 252/373

[58] Field of Search ..... 48/202, 206, 197 R, 48/209, 200, 201; 585/240; 252/373

[56] References Cited

U.S. PATENT DOCUMENTS

| | | | |
|---|---|---|---|
| 2,175,610 | 10/1939 | Linder | 48/206 |
| 3,671,209 | 6/1972 | Teichmann et al. | 48/209 |
| 3,971,635 | 7/1976 | Matthews | 48/202 |
| 4,052,173 | 10/1977 | Schulz | 48/202 |
| 4,340,397 | 7/1982 | Schulz | 48/63 |
| 4,466,807 | 8/1984 | Santen et al. | 48/202 |
| 4,530,702 | 7/1985 | Fetters et al. | 48/209 |

FOREIGN PATENT DOCUMENTS

| | | | |
|---|---|---|---|
| 1435088 | 5/1976 | United Kingdom | 48/202 |

OTHER PUBLICATIONS

Coffman et al., Power from Wastes via Steam Gasification 1978, A.C.S., 48-197R.

*Primary Examiner*—Peter Kratz

*Attorney, Agent, or Firm*—Thomas H. Whaley

[57] ABSTRACT

Toxic refractory organic substances are decomposed by exposing them to an oxidizing medium and steam at a temperature in the range of 2500° F. to 3200° F. for a period of 5 to 500 milliseconds in a reaction chamber. The toxic refractory organic substance can be dioxins, polyhalogenated byphenyls, organophosphates, halogenated biocides, waste streams from the production of said toxic substances, and mixtures thereof.

6 Claims, No Drawings

PROCESS FOR THE THERMAL DECOMPOSITION OF TOXIC REFRACTORY ORGANIC SUBSTANCES

This is a continuation of Ser. No. 786,165, filed Oct. 9, 1985, which s a continuation of application Ser. No. 584,571, filed Feb. 29, 1984, both now abandoned.

BACKGROUND OF THE INVENTION

There are a number of toxic organic substances that are so resistant nto both thermal degradation and biological degradation that their improper disposal results in severe environmental pollution problems. These toxic organic substances usually undergo only partial destruction in conventional incinerators with the result that unreacted or partially oxidized toxic compounds are discharged with the stack gases into the atmosphere and may subsequently cause pollution of the air, soil, and waterways.

DESCRIPTION OF THE INVENTION

This invention relates to a process for the decomposition of toxic refractory organic substances that are unusually resistant to thermal degradation. In this process the toxic refractory organic substances are exposed to an oxidizing medium and steam at a temperature in the range of 2500° F. to 3200° F. for 5 to 500 milliseconds in a combustion chamber in. which they are contacted with incandescent carbon and/or an incandescent inorganic oxide. By means of this procedure, refractory organic substances are typically decomposed with an efficiency of at least 99.99 percent in a single pass through the partial combustion zone. After the removal of gaseous inorganic decomposition products by conventional scrubbing and refining techniques, the exit gas, which comprises carbon monoxide, methane, and hydrogen, may be used as a fuel or synthesis gas.

This process for the destruction of toxic refractory organic substances may be superimposed on an efficient, energy-producing gasification process that operates at temperatures substantially higher than those of air-supported incinerators. In this way the quantitative thermal destruction of toxic refractory organic substances is accomplished at a negligible increase in the cost of producing a clean, medium BTU fuel or synthesis gas.

While the process of this invention can be used to destroy an organic substance that is resistant to thermal and biological degradation, it is of particular value in the destruction of those refractory organic substances that are toxic to living organisms and that when subjected to heating in conventional incinerators yield toxic degradation products that when released into the atmosphere cause serious pollution problems. Such toxic materials include dioxins; polyhalogenated biphenyls; organophosphates, such as Parathion; halogenated biocides, such as hexachlorobenzene, Chlordane, DDT, and 2,4,5-trichlorophenoxyacetic acid; and waste streams from the production of these toxic substances.

In the process of this invention, the toxic refractory organic substance is reacted with an oxidizing medium under conditions so controlled as to maintain a flame or combustion temperature in the range of 2500° F. to 3200° F., preferably in the range of 2800° F. to 3100° F., for a period of from 5 to 500 milliseconds in a reaction chamber that may have a refractory lining and/or that may conttain incandescent carbon or incandescent refractory oxides, such as alumina or zirconia. The high temperature environment is created and maintained by the partial oxidation of the refractory organic substance, incandescent carbon, or both.

The refractory organic substance that is introduced into the combustion chamber may be a liquid, a gas, or a solution or suspension of a solid in a combustible organic liquid.

The oxidizing medium used in this process may be a gas, such as oxygen, oxygen-enriched air, or air that has been sufficiently preheated to sustain the desired flame temperature; or a liquid, such as nitrogen tetroxide. It is preferably oxygen or oxygen-enriched air.

Steam is fed to the gasification chamber to maintain the reaction temperature in the desired range, that is, between 2500° F. and 3200° F., and to provide a reducing atmosphere beyond the partial combustion zone or flame.

The amount of oxygen or other oxidizing medium that is fed into the reaction chamber is dependent upon such factors as the properties of the toxic refractory organic substance and the apparatus in which the degradation of the refractory substance is to be effected. Excellent results have been obtained using the amount of oxidizing medium that is required stoichiometrically for complete combustion of the refractory material as well as more or less than this amount. When the refractory substance is destroyed in a gasifier or in a combination of a torch and a gasifier, the amount of oxidizing medium used is that required for the partial oxidation of the refractory substance and the gasification of the carbonaceous fuel so as to generate a temperature of at least 2500° F.

The relative amounts of steam and oxidizing medium that are used are so regulated as to maintain the desired reaction temperature by balancing the exothermic partial combustion reaction $$C+\tfrac{1}{2}O_2=CO$$

with the endothermic watergas reaction $$C+H_2O=CO+H_2$$

The mixture of partial and complete combustion products leaving the gasifier is passed through a heat exchanger for the recovery of heat and into a conventional scrubber for the removal of noxious inorganic decomposition products, such as hydrogen chloride, hydrogen sulfide, ammonia, or phosphine. The scrubbed product gas may be used as a synthesis gas or fuel. Any solid inorganic impurities introduced with the carbonaceous feed material may be withdrawn from the hearth of the gasifier in the form of a molten slag.

The process of this invention may be carried out in any suitable and convenient apparatus in which the refractory organic material can be exposed to an oxidizing medium and steam at a temperature in the range of 2500° F. to 3200° F., for a period of 5 to 500 milliseconds. It is preferably carried out in a torch, a slagging gasifier, or a combination thereof. For example, it may be carried ou in an aluminalined reaction chamber having inlets for steam and oxidizing medium; an oxypropane torch may be provided as a pilot light. The chamber may be fitted with zirconia cylinders, bricks, rods, saddles, or bars. The thermal decomposition may also be carried out in a slagging, moving-burden gasifier, such as the gasifiers described in detail in U.S. Pat. No.

4,340,397 and U.S. Pat. No. 4,052,173; or in a combiantion of a refractory-lined torch feeding into a gasifier.

In one of the preferred embodiments of the invention, the refractory organic substance is introduced into a reaction chamber that is designed to provide a residence time of 5 to 500 milliseconds wherein it is reacted with an oxidizing medium and steam at a temperature of 2500° F. to 3200° F. The partial combustion products are then contacted with refractory inorganic surfaces that comprise the walls adn internal packing of the reaction chamber which have been heated to incandescence by the reaction products. Steam is fed to the partial combustion zone of the reaction chamber to maintain the temperature in the desired range and to provide a reducing atmospher beyond this zone. The complete and partial combustion products leaving the reaction chamber are passed through a heat exchanger and into a scrubber. The scrubbed product which contains substantially no toxic compounds may be employed as a synthesis gas or fuel.

In another preferred embodiment of the invention, the process is carried out in an apparatus that comprises a slagging, moving-burden gasifier. The gasifier, which is preferably of the type disclosed in U.S. Pat. No. 4,052,173 or U.S. Pat. No. 4,340,397, which are incorporated herein by reference, consists of a vertical shaft furnace surmounted by a conventional lock hopper. It may be operated at pressures of 1 to 100 atmospheres but is preferably operated at atmospheric pressure. The carbonaceous fuel that is introduced through the lock hopper may be, for example, coal, coke, lignite, charcoal, or a briquetted mixture of caking coal and cellulosic waste materials.) An oxygen-rich gas and steam are fed to the hearth zone of the shaft furnace in a ratio so regulated as to maintain the hearth temperature in the range of 2500° F. to 3200° F. while at the same time a toxic refractory organic substance is introduced into the hearth zone.

The refractory organic substance reacts with the oxidizing medium and steam in the partial combustion zone of the shaft furnace and any unreacted or partially reacted portion of it is subjected to further reaction with incandescent carbon at a point just above the partial combustion zone where a reducing atmosphere prevails. The hot gaseous reaction products, which comprise hydrogen, carbon monoxide, carbon dioxide, and methane, preheat the carbonaceous fueld as it descends from the lock hopper to the hearth zone of the gasifier. The inorganic components of the carbonzceous feed material are converted in the hearth zone to a molten slag which may be removed from the bottom of the shaft furnace. The gaseous products (produced in a gasifier of the type described in U.S. Pat. No. 4,052,173) are withdrawn through an exit line from the top of the shaft furnace and quenched and purified in a conventional scrubber.

When employing a gasifier of the type described in U.S. Pat. No. 4,340,397, the raw gaseous products reaching the top of the gasifier are recycled to the partial combustion zone through an internal or external conduit by means of a steam jet. At the same time, at least a portion of the resultant tar-free gas leaving the partial combustion zone is withdrawn as product at a point below the pyrolysis and coking zone of the shaft furnace.

This invention is further illustrated by the following examples.

EXAMPLE 1

The following procedure was carried out in a slagging, movingburden gasifier of the type that is disclosed in U.S. Pat. No. 4,340,397. This gasifier is a vertical shaft furnace that comprises, successively from top to bottom, a preheating and drying zone, a pyrolysis and coking zone, a high temperature reaction zone, and a partial combustion zone.

Sized coke was charged through a lock hopper on top of the gasifier and gasified by partially oxidizing it with oxygen in the presence of steam at a hearth temperature of 2900° F. to 3100° F. This was accomplished by controlling the amounts of oxygen and steam introduced into the partial combustion zone so that the exothermic partial combustion reaction was balanced by the endothermic watergas reaction.

When steady-state operation of the gasifier had been established, a hot steam of hexachlorobenzene dissolved in toluene was fed directly into the partial combustion zone at the rate of 500 $kg/m^2/hr$.

The product gas issuing from the gasifier was analyzed for unreacted hexachlorobenzene and hydrogen chloride. These analyses, which were confirmed by gas chromatographic analysis of the off-gas, indicated that 99.993% of the hexachlorobenzene had been destroyed.

EXAMPLE 2

The following procedure was carried out in an alumina-lined reaction chamber fitted with an internal structure of zirconia rods, which was provided with a torch and a steam/oxygen tuyere. The chamber was sized to afford a residence time of the order of 100 milliseconds at the feed rates employed.

A 55% solution of Malathion n(0,0-dimethyl dithiophosphate of diethyl mercaptosuccinate) in xylenen was fed as fuel to the torch which used oxygen and steam as the reaction medium. The oxygen was fed in an amount that was less than the stoichiometric amount required for complete combustion of the Malathion solution, and the steam flow was regulated to maintain the combustion temperature in the range of 2900° F. to 3100° F.

The off-gas was quenched with aqueous milk of lime in a spray scrubber to remove acidic decomposition products.

Gas chromatographic analysis of the scrubbed gas indicated that 99.9992% of the Malathion had been destroyed.

EXAMPLE 3

The following procedure was carried out in a reaction chamber of the type described in Example 2 which fed into the high temperature reaction zone of a slagging, moving-burden gasifier of the type described in Example 1.

Polychlorinated biphenyl (a mixture of tetrachlorbiphenyl isomers) was burned in the torch, which used oxygen and steam as the reaction medium.

Less than the stoichiometric amount of oxygen required for complete combustion of the polychlorinated biphenyl was fed to the torch. The steam flow was regulated to maintain the flame temperature of the torch at about 3000° F.

The combustion products issuing from the reaction chamber were brought into contact with the incandescent coke in the partial combustion and high temperature reaction zones of the gasifier. During this process, the partial combustion zone of the gasifier was maintained at about 2800° F. The residence time of the polychlorinated biphenyls in the torch and partial combustion zone of the gasifier was 50 to 100 milliseconds.

Analysis of the product gas issuing from the gasifier showed that 99.998% ofo the polychlorinated biphenyls had been destroyed.

What is claimed is:

1. A process for the noncatalytic decomposition of toxic refractory organic substances selected from the group consisting of halogenated oroganic biocides, organophosphates, waste streams from the production of said toxic substances, and mixtures thereof 'by partial' oxidation which comprises reacting a feed stream including said toxic refractory organic substances with oxygen and steam in an amount at least sufficient to convert all of the toxic organic substance entirely to gaseous reaction products comprising carbon monoxide and hydrogen at an autogenous temperature in the range of 2500° F. to 3200° F. for 5 to 500 milliseconds in a refractory lined reaction chamber wherein the toxic refractory organic substances are converted to gaseous reaction products comprising carbon monoxide and hydrogen, contacting said gaseous reaction products at said reaction zone temperature in the range of 2500° to 3200° F. with a packing of an incandescent solid refractory inorganic oxide, and recovering a product comprising carbon monoxide and hydrogen substantially completely free from said toxic refractory organic substances.

2. A process according to claim 1 wherein the toxic refractory organic substance is polychlorinated biphenyl.

3. A process according to claim 1 wherein the feedstream including toxic refractory organic substance is dioxin as a solution or suspension in a combustible organic liquid.

4. A process according to claim 1 wherein the toxic refractory organic substance is hexachlorobenzene.

5. A process according to claim 1 wherein the toxic refractory organic substance is 0,0-dimethyl dithiophosphate of diethyl mercaptosuccinate (malathion)

6. A process according to claim 1 wherein said toxic refractory organic substance is parathion.

* * * * *